US008269673B2

(12) United States Patent
Chiang

(10) Patent No.: US 8,269,673 B2
(45) Date of Patent: Sep. 18, 2012

(54) BROADBAND ANTENNA AND AN ELECTRONIC DEVICE HAVING THE BROADBAND ANTENNA

(75) Inventor: Yuh-Yuh Chiang, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 406 days.

(21) Appl. No.: 12/588,707

(22) Filed: Oct. 26, 2009

(65) Prior Publication Data

US 2010/0123634 A1 May 20, 2010

(30) Foreign Application Priority Data

Nov. 14, 2008 (TW) ..... 97144215 A

(51) Int. Cl.
*H01Q 1/38* (2006.01)

(52) U.S. Cl. ..... 343/700 MS; 343/722

(58) Field of Classification Search ..... None
See application file for complete search history.

(56) References Cited

U.S. PATENT DOCUMENTS

| | | | | |
|---|---|---|---|---|
| 3,812,892 | A * | 5/1974 | Jasinski et al. | 144/339 |
| 6,812,892 | B2 * | 11/2004 | Tai et al. | 343/700 MS |
| 7,391,376 | B2 * | 6/2008 | Yeh et al. | 343/700 MS |
| 7,817,094 | B2 * | 10/2010 | Adachi et al. | 343/702 |
| 7,830,322 | B1 * | 11/2010 | Oliver et al. | 343/770 |
| 2007/0096998 | A1 * | 5/2007 | Chang et al. | 343/702 |
| 2007/0139270 | A1 * | 6/2007 | Takei et al. | 343/700 MS |
| 2009/0295645 | A1 * | 12/2009 | Campero et al. | 343/700 MS |

* cited by examiner

*Primary Examiner* — Trinh Dinh
(74) *Attorney, Agent, or Firm* — Bacon & Thomas, PLLC

(57) ABSTRACT

A broadband antenna for wireless signal transmission of an electronic device comprises a base board, a radiating element, a grounding element, a shorting element, and a feeding point. The radiating element, the grounding element, and the shorting element are disposed on the base board. The radiating element comprises a first slot and a second slot. The second slot is connected to the first slot substantially. The first slot and the second slot are used to adjust the operating band of the broadband antenna. The grounding element is used to ground the broadband antenna. The shorting element is used to connect the radiating element and the grounding element. The feeding point is disposed between an edge of the base board and the shorting element, and the horizontal extended range of the first slot does not exceed the position of the feeding point.

10 Claims, 7 Drawing Sheets

BROADBAND ANTENNA AND AN ELECTRONIC DEVICE HAVING THE BROADBAND ANTENNA

RELATED APPLICATION

This application claims priority under 35 U.S.C. 119 from TAIWAN application serial No. 097144215 filed on Nov. 14, 2008, the contents of which is incorporated herein by reference.

BACKGROUND OF THE INVENTION

1. Field of the Invention

The present invention relates to a broadband antenna and, more particularly, to a broadband antenna which enables broadband transmission through slot adjustments.

2. Description of the Related Art

With advancements in technology, wireless transmission systems have become common in electronic products. However, the traditional antenna can not satisfy the requirements of the transmission of large volumes of data, such as multimedia files; therefore, an antenna with a larger transmission bandwidth is needed.

The prior art technology discloses a type of antenna. Please refer to FIG. 1A. FIG. 1A is a schematic drawing of a prior art antenna 90 disclosed in U.S. Pat. No. 6,812,892 B2. The antenna 90 of the prior art comprises a radiating element 91, a connecting element 92, a grounding element 93, and a feeding point F. The connecting element 92 comprises the first end 921 and the second end 922. The first end 921 is connected to the radiating element 91; the second end 922 is connected to the grounding element 93. The antenna 90 is able to feed signals into the feeding point F for transmission of electronic signals.

Next, please refer to FIG. 1B, which shows the Voltage Standing Wave Ratio (VSWR) at different frequencies for the antenna 90 shown in FIG. 1A. As shown in FIG. 1B, the antenna 90 can operate only in the frequency range between 2.5 GHz and 5.5 GHz. At frequency 2.5 GHz, for example, the bandwidth of the antenna 90 is approximately 250 MHz, and the center frequency is approximately 2450 MHz, therefore, the ratio is approximately (250 MHz/2450 MHz)=10.2041%. As a result, the antenna 90 has limited transmission frequency bands and cannot sustain the present frequency bandwidth requirements of the broadband antennas.

Therefore, it is desirable to provide a broadband antenna to mitigate and/or obviate the aforementioned problems.

SUMMARY OF THE INVENTION

A main objective of the present invention is to provide a broadband antenna which enables broadband transmission through slot adjustments.

Another objective of the present invention is to provide an electronic device having the broadband antenna.

In order to achieve the above mentioned objectives, the electronic device of the invention comprises a broadband antenna and a wireless transmission module. The broadband antenna electrically connects to the wireless transmission module. The broadband antenna comprises a base board, a radiating element, a grounding element, a shorting element, and a feeding point. The radiating element is disposed on the base board. The radiating element comprises a first slot and a second slot. The second slot is connected to the first slot substantially, wherein the first slot and the second slot are used for adjusting the operating frequency band of the broadband antenna. The grounding element is disposed on the base board and used for grounding the broadband antenna. The shorting element is disposed on the base board and used for connecting the radiating element and the grounding element. The feeding point is used for feeding an electric signal. The feeding point is disposed between one edge of the base board and the shorting element, and the horizontal extended range of the first slot does not exceed the position of the feeding point.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
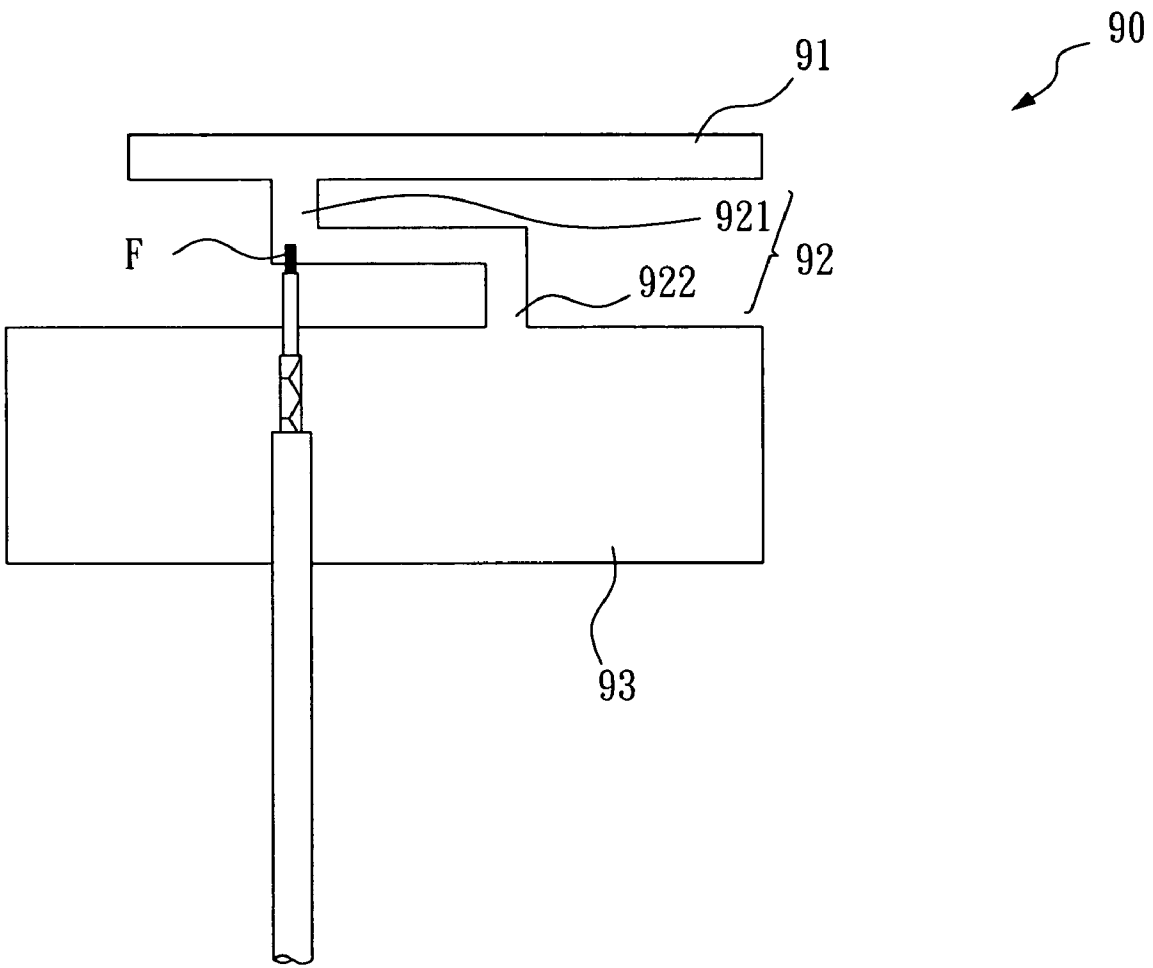
FIG. 1A (Prior Art)
FIG. 1A is a schematic drawing of a prior art antenna.
Figure 1B:
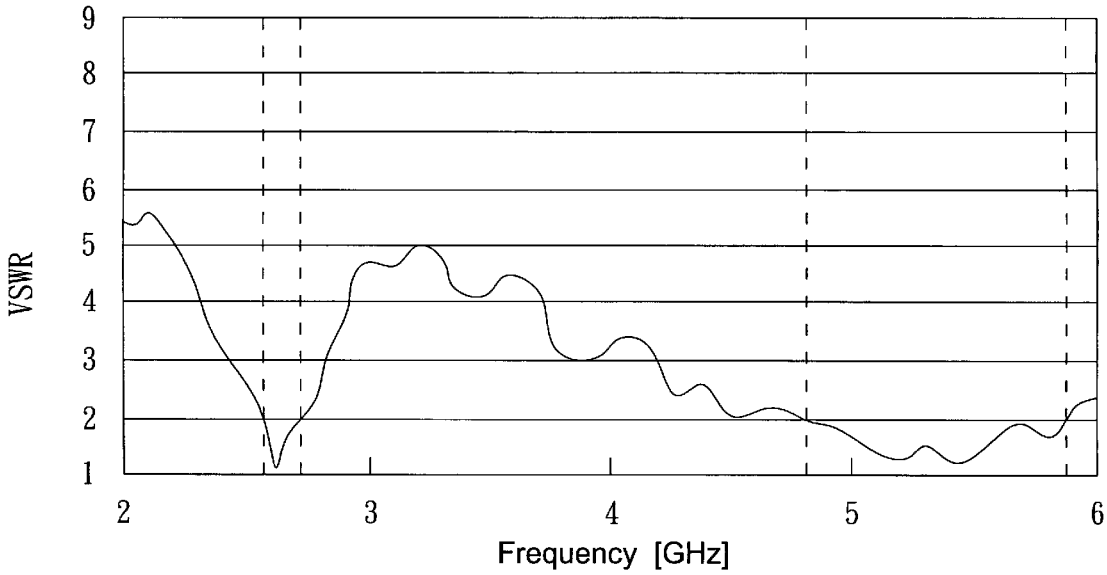
FIG. 1B (Prior Art)
FIG. 1B shows the VSWR at different frequencies according to the prior art antenna shown in FIG. 1A.
Figure 2:
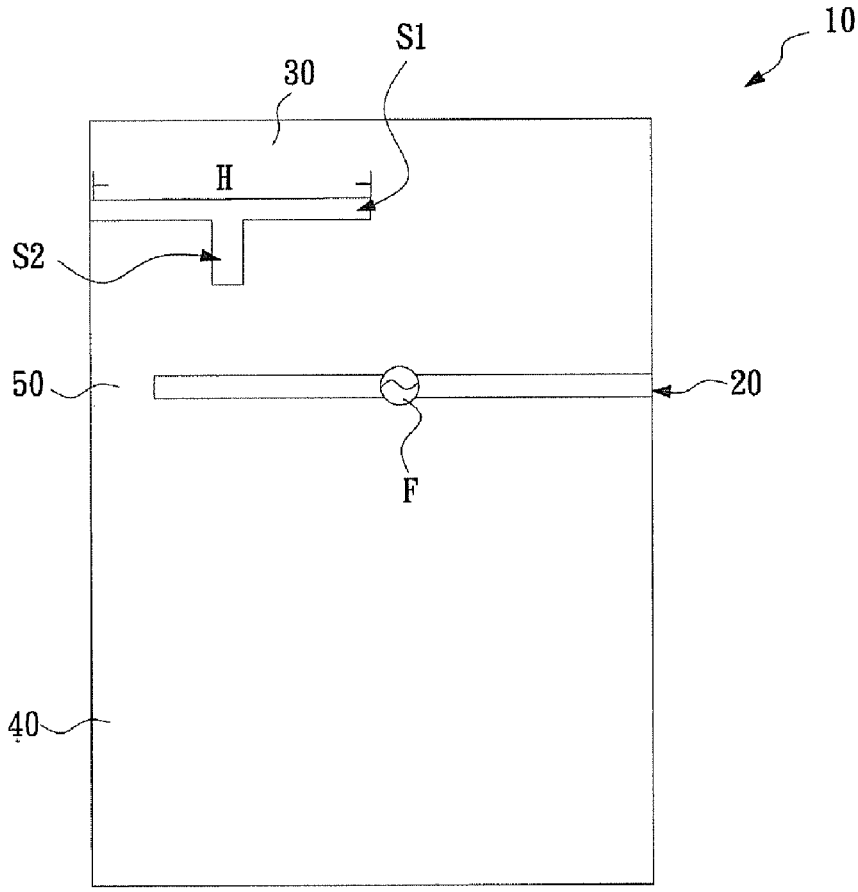
FIG. 2 is a schematic drawing of a broadband antenna according to an embodiment of the invention.

Please refer to FIG. 2. FIG. 2 is a schematic drawing of a broadband antenna according to an embodiment of the invention.

In this embodiment of the present invention, the broadband antenna 10 is a plane structure. The broadband antenna 10 comprises a base board 20, a radiating element 30, a grounding element 40, a shorting element 50, and a feeding point F. The base board 20 is a printed circuit board, a plastic board, or a fiberglass board. The radiating element 30, the grounding element 40, and the shorting element 50 are printed on the base board 20 or produced as a separate piece of electrically conductive material and attached to the base board 20. The radiating element 30 is used for transmitting wireless communication signals to emit the radiation energy. The grounding element 40 is used for grounding the broadband antenna 10. The shorting element 50 is disposed on the base board 20 and used for connecting the radiating element 30 and the grounding element 40.

The broadband antenna 10 further comprises a feeding point F. The feeding point F is disposed between one edge of the base board 20 and the shorting element 50. In the embodiment, the length from the feeding point F to the edge of the base board 20 is shorter than the length from the feeding point F to the shorting element 50. The feeding point F and a feeding line (not shown) are electrically connected to each other and used for transmitting an electrical signal. The feeding line can be an RF cable or other type of transmission line.

The radiating element 30 further comprises a first slot S1 and a second slot S2. The second slot S2 is connected to the first slot S1 substantially. A horizontal extended range H of the first slot S1 does not exceed the position of the feeding point F, and the second slot S2 is disposed substantially at the center of the first slot S1. The radiating element 30 is used to adjust the operation frequency band of the broadband antenna 10 with the first slot S1 and the second slot S2.

Figure 3A:
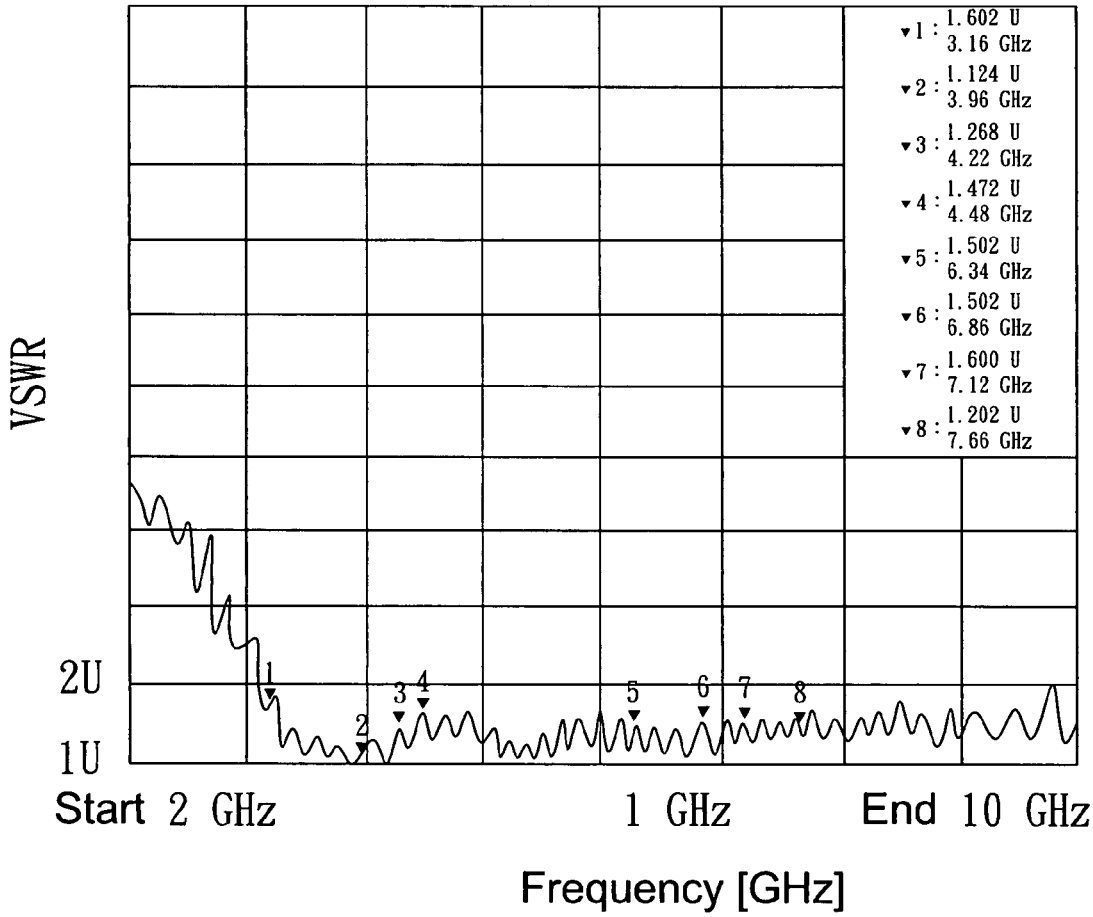
FIG. 3A shows the VSWR at different frequencies according to the broadband antenna of the invention shown in FIG. 2.
Figure 3B:
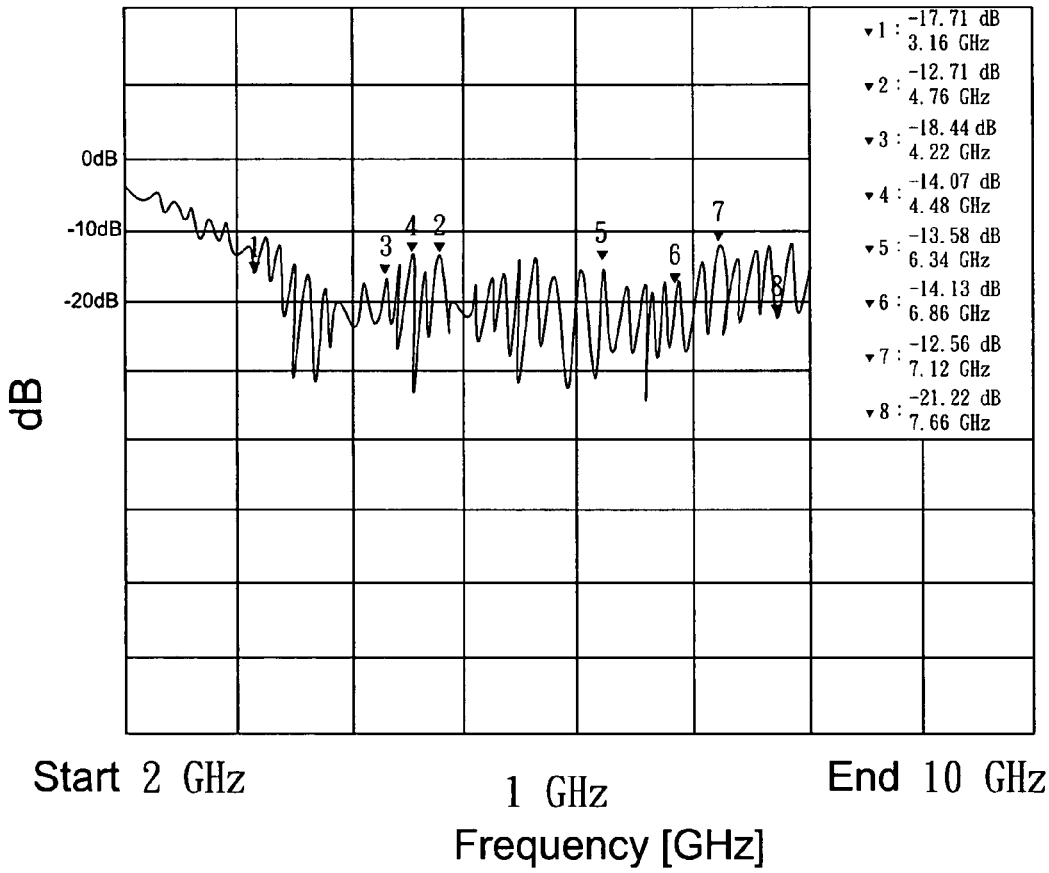
FIG. 3B shows the dB value at different frequencies according to the broadband antenna of the invention shown in FIG. 2.
Figure 3C:
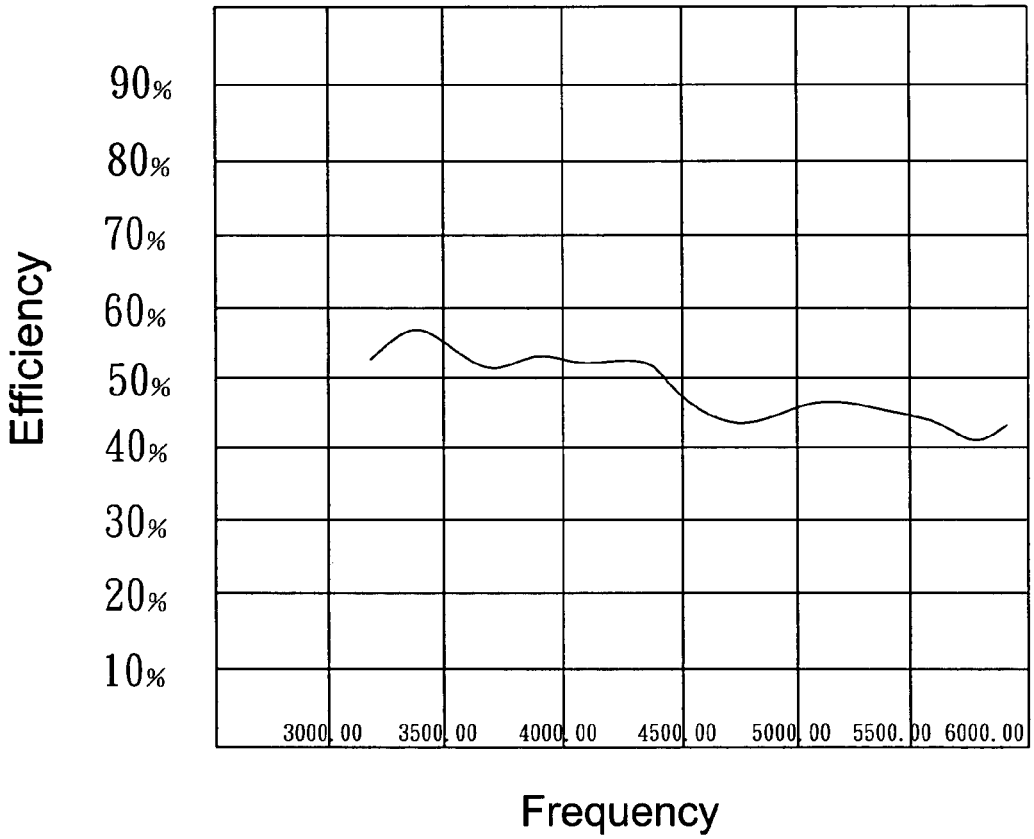
FIG. 3C shows the radiation efficiency at different frequencies according to the broadband antenna of the invention shown in FIG. 2.

Please refer to FIG. 3A to FIG. 3C. FIG. 3A shows the VSWR at different frequencies according to the broadband antenna of the invention shown in FIG. 2. FIG. 3B shows the dB value at different frequencies according to the broadband antenna of the invention shown in FIG. 2. FIG. 3C shows the radiation efficiency according to the broadband antenna of the invention shown in FIG. 2.

As shown in FIG. 3A and FIG. 3B, if the broadband antenna 10 can be operated under 2 of VSWR and at dB value less than −9.54 dB, with the effect of the structure and the slots aforementioned, the broadband antenna 10 is capable of transmitting signals with frequencies from 3.16 GHz to 10 GHz. Therefore, the bandwidth of the broadband antenna 10 is about (10 GHz−3.16 GHz)=6.84 GHz. The center frequency of the broadband antenna 10 is (3.16 GHz+10 GHz)/2=6.58 GHz, and the bandwidth percentage is about (6.84 GHz/6.58 GHz)=103.9514%. In comparison with the antenna 90 of the prior art, the broadband antenna 10 has a broader bandwidth. As shown in FIG. 3C, the efficiency from frequency 3.16 GHz to 6 GHz can be greater than 40%; therefore, the broadband antenna 10 has superior transmission efficiency at low frequency or high frequency bandwidths. In addition, the height of the broadband antenna 10 is about 9 mm. In comparison with the prior art antenna 90, the broadband antenna 10*a* is capable of saving a greater amount of structural space.

Figure 4:
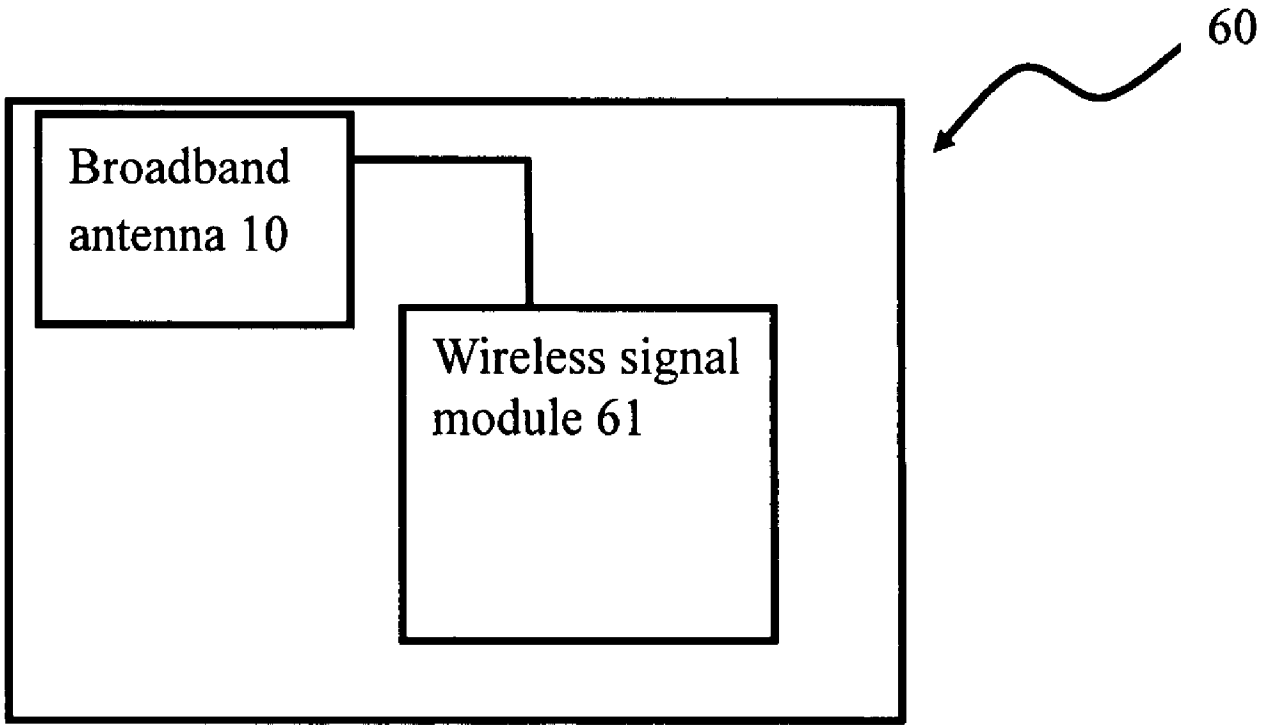
FIG. 4 is a functional block drawing of an electronic device of the invention.

Please refer to FIG. 4. FIG. 4 is a functional block drawing of an electronic device of the invention.

In one embodiment of the invention, an electronic device 60 can be a notebook computer or any other portable device. As shown in FIG. 4, the electronic device 60 comprises the broadband antenna 10 and a wireless signal module 61. The electronic device 60 uses RF cables to provide a feed to the broadband antenna 10, and is connected to a wireless signal module 61 so that the wireless signal module 61 can process signals from the broadband antenna 10, such as the transmitting or receiving of signals. The electronic device 60 can thus use the broadband antenna 10 to transmit or receive wireless signals from or to other devices (not shown).

Although the present invention has been explained in relation to its preferred embodiment, it is to be understood that many other possible modifications and variations can be made without departing from the spirit and scope of the invention as hereinafter claimed.

What is claimed is:

1. A broadband antenna comprising:

a base board;

a radiating element disposed on the base board; the radiating element comprises a first slot and a second slot, the second slot being connected to the first slot substantially, wherein the first slot and the second slot are used for adjusting the operating frequency band of the broadband antenna;

a grounding element disposed on the base board and used for grounding the broadband antenna;

a shorting element disposed on the base board and used for connecting the radiating element and the grounding element;

a third slot disposed between the radiating element, the grounding element, and the shorting element, wherein the third slot does not connect to the first slot and the second slot; and a feeding point used for feeding an electric signal, wherein the feeding point is disposed on the third slot and between one edge of the base board and the shorting element, and a horizontal extended range of the first slot does not exceed the position of the feeding point.

2. The broadband antenna as claimed in claim 1, wherein the second slot is disposed at the center of the first slot substantially.

3. The broadband antenna as claimed in claim 1, wherein the length from the feeding point to the edge of the base board is shorter than the length from the feeding point to the shorting element.

4. The broadband antenna as claimed in claim 1, wherein the broadband antenna is a plane structure.

5. The broadband antenna as claimed in claim 1, wherein the radiating element, the grounding element, and the shorting element are printed on the base board or produced as a separate piece of electrically conductive material and attached to the base board.

6. An electronic device having a broadband antenna and capable of wireless transmissions comprising:

a wireless signal module; and a broadband antenna electrically connected to the wireless signal module, the broadband antenna comprising:

a base board;

a radiating element disposed on the base board; the radiating element comprises a first slot and a second slot, the second slot being connected to the first slot substantially, wherein the first slot and the second slot are used for adjusting the operation frequency band of the broadband antenna;

a grounding element disposed on the base board and used for grounding the broadband antenna;

a shorting element disposed on the base board and used for connecting the radiating element and the grounding element;

a third slot disposed between the radiating element, the grounding element, and the shorting element, wherein the third slot does not connect to the first slot and the second slot; and a feeding point used for feeding an electric signal, wherein the feeding point is disposed on the third slot and between an edge of the base board and the shorting element, and a horizontal extended range of the first slot does not exceed the position of the feeding point.

7. The electronic device having a broadband antenna as claimed in claim 6, wherein the second slot is disposed substantially at the center of the first slot.

8. The electronic device having a broadband antenna as claimed in claim 6, wherein the length from the feeding point to the edge of the base board is shorter than the length from the feeding point to the shorting element.

9. The electronic device having a broadband antenna as claimed in claim 6, wherein the broadband antenna is a plane structure.

10. The electronic device having a broadband antenna as claimed in claim 6, wherein the radiating element, the grounding element, and the shorting element are printed on the base board or produced as a separate piece of electrically conductive material and attached to the base board.

* * * * *